US008702407B2

(12) United States Patent
Schofield et al.

(10) Patent No.: US 8,702,407 B2
(45) Date of Patent: Apr. 22, 2014

(54) MULTISTAGE ROOTS VACUUM PUMP HAVING DIFFERENT TIP RADIUS AND MESHING CLEARANCE FROM INLET STAGE TO EXHAUST STAGE

(75) Inventors: Nigel Paul Schofield, Horsham (GB); Peter Hugh Birch, Horsham (GB)

(73) Assignee: Edwards Limited, West Sussex (GB)

( * ) Notice: Subject to any disclaimer, the term of this patent is extended or adjusted under 35 U.S.C. 154(b) by 0 days.

(21) Appl. No.: 13/224,301

(22) Filed: Sep. 1, 2011

(65) Prior Publication Data

US 2011/0318210 A1 Dec. 29, 2011

Related U.S. Application Data

(62) Division of application No. 11/989,920, filed as application No. PCT/GB2006/002679 on Jul. 18, 2006, now abandoned.

(30) Foreign Application Priority Data

Aug. 2, 2005 (GB) ..... 0515905.8

(51) Int. Cl.
*F03C 2/00* (2006.01)
*F03C 4/00* (2006.01)
*F04C 2/00* (2006.01)

(52) U.S. Cl.
USPC ..... 418/9; 418/190; 418/206.5

(58) Field of Classification Search
USPC ..... 418/9, 140, 142, 201.1, 206.1, 206.5, 418/189, 190
See application file for complete search history.

(56) References Cited

U.S. PATENT DOCUMENTS

| | | | | |
|---|---|---|---|---|
| 4,068,984 | A | 1/1978 | Spindler | |
| 6,699,023 | B2 * | 3/2004 | Naito et al. | 418/9 |
| 2003/0223897 | A1 * | 12/2003 | Ferentinos | 418/9 |
| 2005/0069440 | A1 | 3/2005 | Naito | |
| 2005/0118035 | A1 | 6/2005 | Naito | |
| 2010/0158728 | A1 | 6/2010 | Schofield et al. | |

FOREIGN PATENT DOCUMENTS

| | | | | |
|---|---|---|---|---|
| DE | 4232119 | A1 | | 3/1994 |
| EP | 1536140 | A1 | | 6/2005 |
| GB | 2175956 | A | | 12/1986 |
| JP | 03111690 | A | * | 5/1991 |
| JP | 05018379 | A | * | 1/1993 |
| JP | 5312173 | | | 11/1993 |
| JP | 2000120538 | | | 4/2000 |
| JP | 2002364569 | A | * | 12/2002 |
| WO | 2004083643 | A1 | | 9/2004 |

OTHER PUBLICATIONS

JP 2002364569 A, Aikawa et al., Multi-Stage Roots Vacuump Pump, Dec. 18, 2002—English Translation.*

(Continued)

*Primary Examiner* — Theresa Trieu
(74) *Attorney, Agent, or Firm* — Westman, Champlin & Koehler, P.A.

(57) ABSTRACT

A multistage vacuum pump includes a stator housing a multistage rotor assembly, each stage having intermeshing Roots rotor components, wherein the tip radius of the rotor components at an inlet stage of the pump is larger than the tip radius of the rotor components at an exhaust stage of the pump, wherein a meshing clearance between the rotor components at the inlet stage of the pump is greater than a meshing clearance between the rotor components at the exhaust stage of the pump.

19 Claims, 2 Drawing Sheets

(56) References Cited

OTHER PUBLICATIONS

JP 05018379 A, Nakano et al., Multi-Stage Roots Vacuum Pump, Jan. 26, 1993—English Translation.*
United Kingdom Search Report dated Nov. 15, 2005 for Application No. GB0515905.8.
PCT International Search Report dated Oct. 10, 2006 for Application No. PCT/GB20061002679.
PCT International Written Opinion dated Oct. 10, 2006 for Application No. PCT/GB2006/002679.
Prosecution history from corresponding U.S. Appl. No. 11/989,920 including: Amendment dated Jan. 3, 2011; Office Action dated Jul. 23, 2010; Response to Restriction Requirement dated Jun. 14, 2010; Office Action dated May 21, 2010; Preliminary Amendment dated Feb. 1, 2008.
Prosecution history from corresponding Chinese Application No. 200680028728.9 including: First Office Action dated Jul. 17, 2009; Response dated Jan. 27, 2010; Second Office Action dated Jan. 30, 2012.
Prosecution history from corresponding Japanese Application No. 2008-524573 including: Office Action dated Jul. 7, 2011; Response dated Dec. 21, 2011; Response dated Jan. 3, 2012; Final Rejection dated Jul. 17, 2012.
Prosecution history from corresponding Korean Application No. 2008-7002669 including: Office Action dated Nov. 6, 2012; Response dated Mar. 20, 2013; Final Rejection dated Aug. 16, 2013.
Prosecution history from corresponding Taiwanese Application No. 095128141 including: Office Action dated Jun. 29, 2012; Search Report dated Jun. 27, 2012; Response dated Sep. 25, 2012; Decision dated Oct. 16, 2012; Response dated Mar. 20, 2013.

* cited by examiner

MULTISTAGE ROOTS VACUUM PUMP HAVING DIFFERENT TIP RADIUS AND MESHING CLEARANCE FROM INLET STAGE TO EXHAUST STAGE

CROSS REFERENCE

This is a divisional application of prior application Ser. No. 11/989,920 filed Feb. 1, 2008, and claims priority from International Application No. PCT/GB2006/002679, filed Jul. 18, 2006, which application claims priority from United Kingdom Application No. GB 0515905.8 filed Aug. 2, 2005.

BACKGROUND OF THE INVENTION

The present invention relates to a vacuum pump, and in particular to a multistage Roots vacuum pump.

A multistage Roots pump generally comprises a pair of shafts each supporting plurality of rotor components within a housing providing a stator component for the pump. The stator comprises a gas inlet, a gas outlet and a plurality of pumping chambers, with adjacent pumping chambers being separated by a transverse wall. A gas flow duct connects a chamber outlet from one pumping chamber to a chamber inlet of the adjacent, downstream pumping chamber.

Each pumping chamber houses a pair of lobed Roots rotor components to provide a pumping stage of the pump. The rotor components are housed with the pumping chamber such that there is a small clearance between the rotor components and between each rotor component and an inner wall of the pumping chamber.

As the rotors do not come into contact with each other or with the pump housing, a multistage Roots pump can be operated at high rotational speeds up to 12,000 rpm or even higher. With rotation of the shafts, the rotor components of each pair are rotated in opposite directions at high speed to draw gas through the chamber inlet and transport the gas through the pumping chamber without internal compression to the chamber outlet. The gas thus passes through each of the pumping chambers before being exhaust from the gas outlet of the housing.

The energy required to transport the gas through the pumping chambers is dependent, amongst others, on the volume of the pumping chambers and the downstream pressure acting on the gas as it is transported through the pumping chamber. In order to compress the gas as it passes through the multistage pump, and thereby generate a vacuum at the inlet of the housing, and reduce energy consumption, it is known to progressively reduce the width of the pumping chambers from the inlet stage to the exhaust stage, and thereby progressively reduce the volume of the pumping chambers. The ratio between the volume of the inlet stage of the pump and the volume of the outlet stage of the pump, commonly referred to as the "volume ratio" of the pump, thus determines both the power consumption of the pump and the size of the vacuum which can be generated at the inlet of the housing.

By reducing the width of the pumping stages, the thickness of the rotor components must decrease progressively from the inlet to the outlet of the pump. Whilst this tends not to be a problem at low volume ratios, for example up to 5:1, at higher ratios the rotor components of the exhaust stage can become very thin. For example, for a pump having rotor components of 30 mm thickness at the inlet stage, a rotor thickness of 1.5 mm would be required at the exhaust stage to achieve a volume ratio of 20:1. This can make machining and mounting of the rotor components very difficult. Furthermore, due to the varying thermal expansions between the rotor components and the stator from the inlet stage to the exhaust stage, it can be difficult to maintain small clearances between the rotor components and the stator, particularly at the exhaust stage where the rotor components are thin, and this can significantly reduce the pumping efficiency of the pump.

BRIEF SUMMARY OF THE INVENTION

It is an aim of at least the preferred embodiment of the present invention to seek to solve these and other problems.

The present invention provides a multistage vacuum pump comprising a stator housing a multistage rotor assembly, each stage comprising intermeshing Roots rotor components, wherein the tip radius of the rotor components at an inlet stage of the pump is larger than the tip radius of the rotor components at an exhaust stage of the pump.

By providing a pump where the tip radius of the exhaust stage rotor components is smaller than the tip radius of the inlet stage rotor components, a pump having a relatively high volume ratio of at least 10:1, more preferably of at least 15:1 can be achieved without having to reduce the thickness of the rotor components at the exhaust stage to the extent described above. For example, where the inlet stage rotor components have a thickness of around 30 mm, a pump having a relatively high volume ratio can be achieved with exhaust stage rotor components having a thickness of around 5 mm.

The pump may comprise a first plurality of pumping stages each comprising rotor components of a first tip radius, and a second plurality of pumping stages each comprising rotor components of a second tip radius smaller than the first tip radius. For example, each of the first and second plurality of pumping stages may comprise at least two pumping stages. Alternatively, the tip radius of the rotor components may progressively decrease from the inlet stage of the pump to the exhaust stage of the pump. Therefore, in more general terms the pump may comprise a first number (one or more) pumping stages each comprising rotor components of a first tip radius, and a second number (one or more) of pumping stages each comprising rotor components of a second tip radius smaller than the first tip radius.

To allow the pump to operate at maximum nominal speed during roughing, that is, when a chamber attached to an inlet of the pump is evacuated from atmospheric pressure, a pressure relief valve 5 may be located between the first plurality of pumping stages and the second plurality of pumping stages for selectively exhausting gas from the pump. The pressure relief valve 5 is preferably configured to automatically close when the pressure of gas at the valve inlet falls below atmospheric pressure, at which point the second plurality of pumping stages become effective in further reducing the pressure at the inlet of the pump and enhancing the net pumping speed.

Each of the rotor components preferably comprises a plurality of lobes, with the inlet stage rotor components preferably having the same number of lobes as the exhaust stage rotor components. The rotor components of a stage may have the same profile, or different profiles. For example, one of the rotor components of a stage may have sockets for receiving the lobes of the other rotor component of that stage.

The rotor assembly preferably comprises two intermeshing sets of Roots rotor components, each set being mounted on a respective shaft for rotation relative to the stator. Alternatively, each set of rotor components may be integral with the shaft, with the stator being provided by two stator "half shells" that are assembled once the shafts have been mounted within one of the half shells.

The meshing clearance between the rotor components at the inlet stage of the pump is preferably greater, most preferably between 10 and 30% greater, than the meshing clearance between the rotor components at the exhaust stage of the pump. The rotor components at the inlet stage of the pump may be used to "time" the rotors to gears connecting the shafts so that the shafts are rotated synchronously but in opposite directions. The larger meshing clearance between the rotor components at the inlet stage of the pump can thus facilitate the assembly of the pump, whilst the smaller meshing clearance between the rotor components at the exhaust stage of the pump can maintain the ultimate power consumption and pressure at acceptable levels.

BRIEF DESCRIPTION OF THE SEVERAL VIEWS OF THE DRAWING

Preferred features of the present invention will now be described with reference to the accompanying drawing, in which.

DETAILED DESCRIPTION OF THE INVENTION

Figure 1:
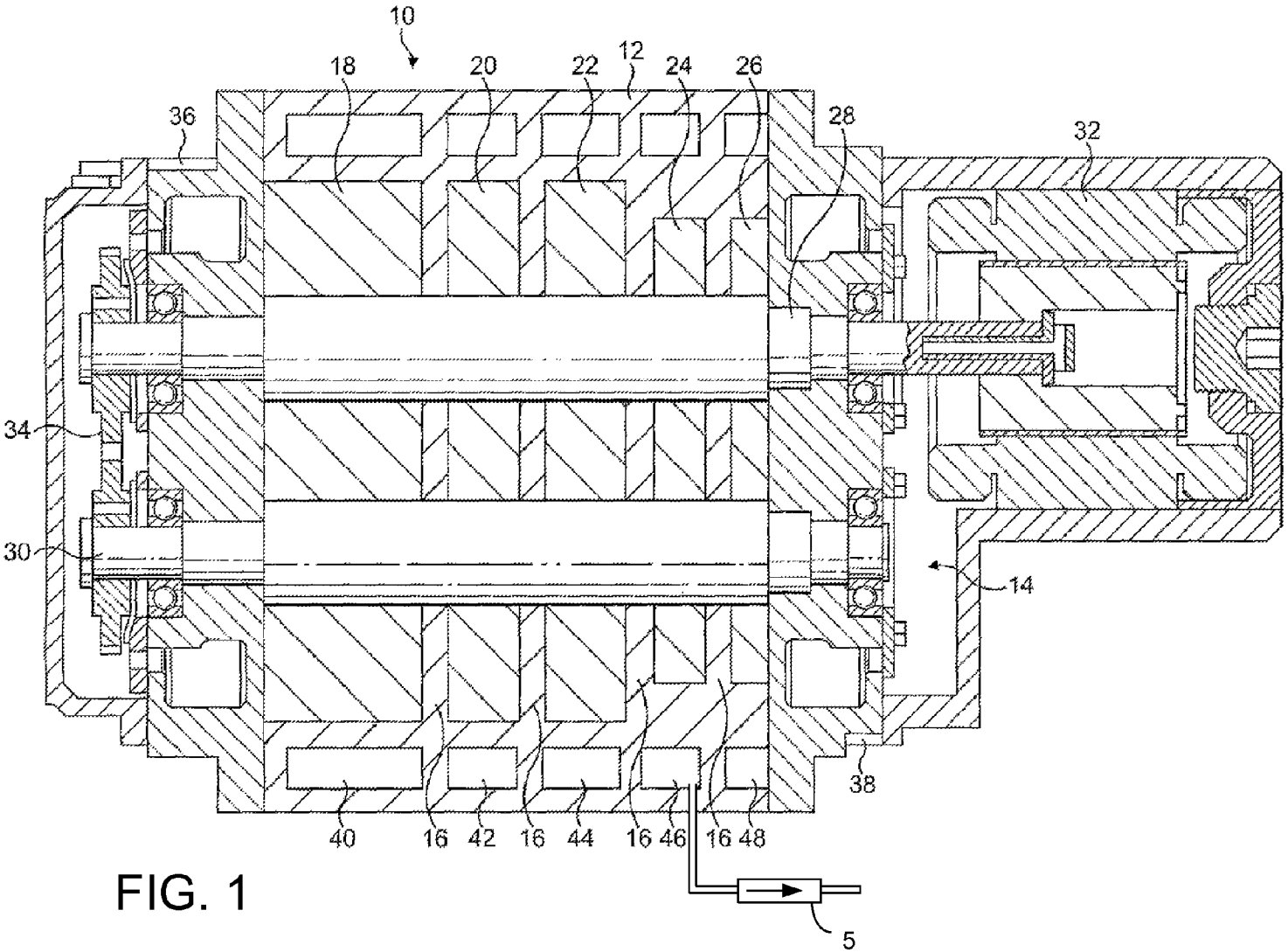
FIG. 1 illustrates a multistage vacuum pump comprising two sets of intermeshing rotor components.

With reference first to FIG. 1, a multi-stage vacuum pump 10 comprises a stator 12 housing a multistage rotor assembly 14. The stator 12 comprises a plurality of transverse walls 16 which divide the stator 12 into a plurality of pumping chambers. In this example, the stator 12 is divided into five pumping stages, although the stator 12 may be divided into any number of pumping stages required to provide the pump 10 with the desired pumping capacity.

The rotor assembly 14 comprises two intermeshing sets of lobed Roots rotor components 18, 20, 22, 24, 26, each set being mounted on a respective shaft 28, 30. Each shaft 28, 30 is supported by bearings for rotation relative to the stator 12. The shafts 28, 30 are mounted within the stator 12 so that each pumping chamber houses a pair of intermeshing rotor components, which together provide a stage of the pump 10. One of the shafts 28 is driven by a motor 32 connected to one end of that shaft 28. The other shaft 30 is connected to that shaft 28 by means of meshed timing gears 34 so that the shafts 28, 30 are rotated synchronously but in opposite directions within the stator 12.

A pump inlet 36 communicates directly with the inlet pumping stage, which comprises rotor components 18, 18' and pump outlet 38 communicates directly with the exhaust pumping stage, which comprises rotor components 26, 26'. Gas passageways 40, 42, 44, 46, 48 are provided within the pump 10 to permit the passage therethrough of pumped gas from the inlet 36 to the outlet 38.

In order to achieve a reduced pressure at the inlet 36 of the pump 10, the volume of the pumping chambers defined within the stator 12 progressively decreases from the inlet pumping stage to the exhaust pumping stage. In this example, the reduction in the volume of the first three pumping chambers is achieved by progressively reducing the thickness of the pumping chambers, and the reduction in the volume of the last two pumping chambers is achieved both by progressively reducing the thickness of the pumping chambers and by reducing the diameter of the pumping chambers in comparison to the first three pumping chambers.

Figure 2:
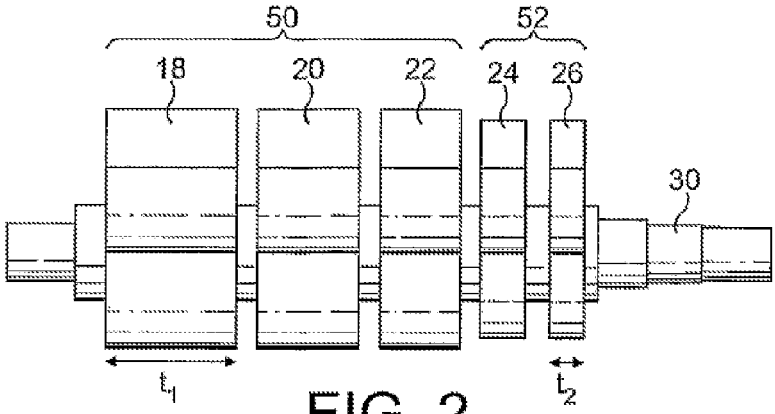
FIG. 2 illustrates a set of rotor components of the pump of FIG. 1.

The sets of rotor components are profiled in order to maintain small clearances between the walls of the pumping chambers and the surfaces of the rotor components. One of the sets of rotor components is illustrated in more detail in FIG. 2. The thickness t of the rotor components progressively decreases from a thickness $t_1$ of the inlet stage rotor component 18 to a thickness $t_2$ of the exhaust stage rotor component 26.

The rotor components are divided into a plurality of numbers of rotor components, each number comprising one or more rotor components of a particular tip radius, that is, the maximum distance d between the outer profile of the rotor component and the centre of the rotor component. In the illustrated example, the rotor components are divided into a first plurality of rotor components 50 having a tip radius $d_1$ and a second plurality of rotor components 52 having a tip radius $d_2$, where $d_2$ is smaller than $d_1$, preferably at least 15% smaller than $d_1$, more preferably at least 20% smaller than $d_1$. For the example illustrated in FIGS. 1 and 2, the first plurality of rotor components 50 comprises the three rotor components 18, 20, 22 proximate the inlet 36 of the pump 10, and the second plurality of rotor components 52 comprising the two rotor components 24, 26 proximate the outlet 38 of the pump 10.

The number and size of the pumping stages may be varied according to the required pumping capacity. For example, a six stage vacuum pump may comprises three rotor components of tip radius $d_1$ and three rotor components of tip radius $d_2$, or three rotor components of tip radius $d_1$, two rotor components of tip radius $d_2$, and one rotor component of tip radius $d_3$, where $d_1>d_2>d_3$.

Figure 3:
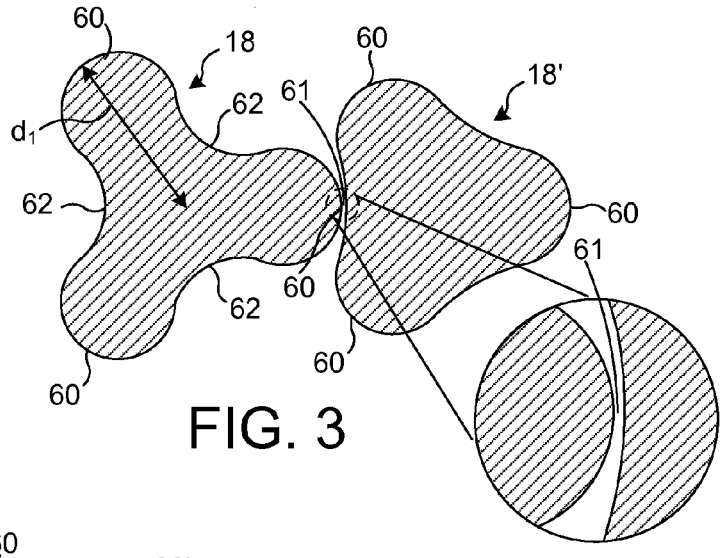
FIG. 3 illustrates the profiles of the rotor components of an inlet stage of the pump of FIG. 1.
Figure 4:
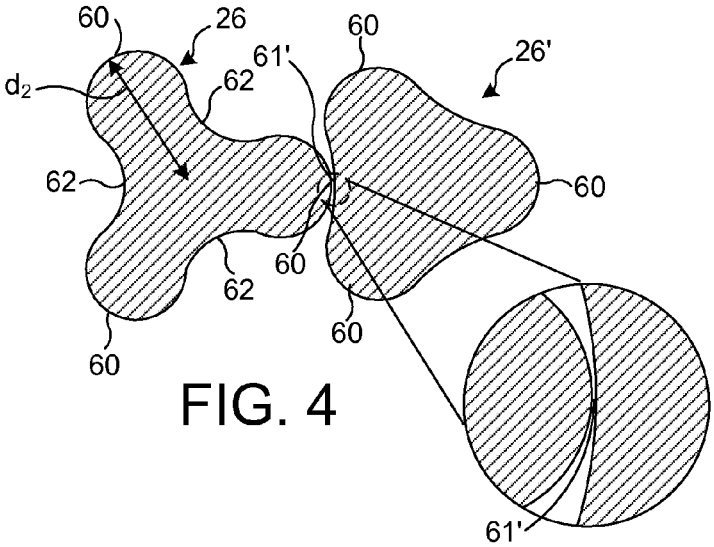
FIG. 4 illustrates the profiles of the rotor components of an exhaust stage of the pump of FIG. 1.

Each of the rotor components 18, 20, 22, 24, 26 may comprise the same number of lobes. As illustrated in FIGS. 3 and 4, each of the rotor components comprises three lobes 60, although the rotor components may have any number of lobes, for example between two and five lobes. The lobes may have any desired curved profile. For example, as illustrated in FIG. 3, one of the rotor components 18; 26 of a stage may comprise sockets 62 for receiving the lobes of the other rotor components 18', 26' of that stage.

By reducing the tip radius of at least the exhaust stage rotor component, the required reduction of the thickness of the exhaust stage pumping component to achieve a relatively high volume ratio is less than that required if the tip radius of the exhaust stage pumping component was the same as that of the inlet stage rotor component. For example, if the tip radius was held at a constant value, the thickness of the exhaust stage rotor component would need to around 5% that of the inlet stage rotor component to achieve a volume ratio of 20:1. If, however, the tip radius of the exhaust stage pumping component was between 15 and 20% smaller than that of the inlet stage rotor component, the thickness of the exhaust stage rotor component would only need to around 10-15% that of the inlet stage rotor component to achieve the same volume ratio, thereby facilitating machining and mounting of the exhaust stage pumping components.

The meshing clearance 61 between the rotor components 18, 18' at the inlet stage of the pump 10 is preferably greater, most preferably between 10 and 30% greater, than the meshing clearance 61' between the rotor components 26, 26' at the exhaust stage of the pump 10. The rotor components 18, 18' at the inlet stage of the pump may be used to "time" the rotors to the gears 34, and so the larger meshing clearance between the inlet stage rotor components 18, 18' can thus facilitate the assembly of the pump 10. The smaller meshing clearance between the exhaust stage rotor components 26, 26' can maintain the ultimate power consumption and pressure at acceptable levels, the extra clearance between the inlet stage rotor components 18, 18' having a negligible effect on ultimate power and pressure, and on peak volumetric pumping speed.

The invention claimed is:

1. A multistage vacuum pump comprising a stator housing a multistage rotor assembly, each stage comprising intermeshing Roots rotor components, wherein a tip radius of the rotor components at an inlet stage of the pump is larger than a tip radius of the rotor components at an exhaust stage of the pump, wherein a meshing clearance between the rotor components at the inlet stage of the pump is greater than a meshing clearance between the rotor components at the exhaust stage of the pump.

2. The vacuum pump according to claim 1 wherein the tip radius of the exhaust stage rotor components is at least 15% smaller than the tip radius of the inlet stage rotor components.

3. The vacuum pump according to claim 2 wherein the tip radius of the exhaust stage rotor components is at least 20% smaller than the tip radius of the inlet stage rotor components.

4. The vacuum pump according to claim 3 wherein the pump comprises a first number of pumping stages each comprising rotor components of a first tip radius, and a second number of pumping stages each comprising rotor components of a second tip radius smaller than the first tip radius.

5. The vacuum pump according to claim 4 wherein each of the first and second numbers of pumping stages comprises a plurality of pumping stages.

6. The vacuum pump according to claim 5 comprising a one-way valve located between the first number of pumping stages and the second number of pumping stages for exhausting from the stator gas at a pressure above atmospheric pressure.

7. The vacuum pump according to claim 6 wherein each of the rotor components comprises a plurality of lobes, and wherein the rotor components at the inlet stage of the pump have the same number of lobes as the rotor components at the exhaust stage of the pump.

8. The vacuum pump according to claim 7 wherein each of the rotor components has between two and five lobes.

9. The vacuum pump according to claim 8 wherein each of the rotor components has three lobes.

10. The vacuum pump according to claim 9 wherein each stage comprises rotor components having different profiles.

11. The vacuum pump according to claim 10 wherein one of the rotor components of a stage comprises pockets for receiving the lobes of the other rotor component of that stage.

12. The vacuum pump according to claim 5 comprising a one-way valve located between the first number of pumping stages and the second number of pumping stages for exhausting from the stator gas at a pressure above atmospheric pressure.

13. The vacuum pump according to claim 12 wherein each of the rotor components comprises a plurality of lobes, and wherein the rotor components at the inlet stage of the pump have the same number of lobes as the rotor components at the exhaust stage of the pump.

14. The vacuum pump according to claim 4 comprising a one-way valve located between the first number of pumping stages and the second number of pumping stages for exhausting from the stator gas at a pressure above atmospheric pressure.

15. The vacuum pump according to claim 4 wherein each of the rotor components comprises a plurality of lobes, and wherein the rotor components at the inlet stage of the pump have the same number of lobes as the rotor components at the exhaust stage of the pump.

16. The vacuum pump according to claim 15 wherein one of the rotor components of a stage comprises pockets for receiving the lobes of the other rotor component of that stage.

17. The vacuum pump according to claim 16 wherein the rotor assembly comprises two intermeshing sets of Roots rotor components, each set being mounted on a respective shaft for rotation relative to the stator.

18. The vacuum pump according to claim 3 wherein the pump comprises a first number of pumping stages each comprising rotor components of a first tip radius, and a second number of pumping stages each comprising rotor components of a second tip radius smaller than the first tip radius.

19. The vacuum pump according to claim 2 wherein the pump comprises a first number of pumping stages each comprising rotor components of a first tip radius, and a second number of pumping stages each comprising rotor components of a second tip radius smaller than the first tip radius.

* * * * *